US005609458A

United States Patent [19]

Hanaoka et al.

[11] Patent Number: 5,609,458

[45] Date of Patent: Mar. 11, 1997

[54] METHOD OF CHARGING COAL INTO CHAMBER FURNACE-TYPE COKE OVEN AND APPARATUS THEREFOR

[75] Inventors: Kouji Hanaoka; Katsutoshi Igawa, both of Okayama; Seiji Taguchi, Chiba; Takashi Matsui; Kenichi Sorimachi, both of Okayama, all of Japan

[73] Assignee: Kawasaki Steel Corporation, Kobe, Japan

[21] Appl. No.: 403,205

[22] Filed: Mar. 13, 1995

[30] Foreign Application Priority Data

Mar. 23, 1994 [JP] Japan ..... 6-051847

[51] Int. Cl.[6] ..... C10B 31/02

[52] U.S. Cl. ..... 414/173; 202/262; 222/236; 414/194; 414/195; 414/786

[58] Field of Search ..... 414/158, 161, 414/172, 173, 193–195, 210, 211, 216, 786; 110/275, 276; 202/262; 222/236

[56] References Cited

U.S. PATENT DOCUMENTS

| | | | |
|---|---|---|---|
| 1,039,533 | 9/1912 | Hein | 202/262 X |
| 2,538,944 | 1/1951 | Miller | 414/195 X |
| 4,714,396 | 12/1987 | Bernard et al. | 414/161 |
| 5,030,054 | 7/1991 | Reschly et al. | 414/195 X |

FOREIGN PATENT DOCUMENTS 0087144 8/1983 European Pat. Off. .

OTHER PUBLICATIONS

Patent Abstracts of Japan, vol. 007, No. 259, 18 Nov. 1983, Japan 58142972 abstract (Shin Nippon Seitetsu) 25 Aug. 1983.

Patent Abstracts of Japan, vol. 018, No. 328, 22 Jun. 1994, Japan 06073378 abstract (Kawasaki Steel Corp) 15 Mar. 1994.

*Primary Examiner*—David A. Bucci

*Attorney, Agent, or Firm*—Dvorak and Traub

[57] ABSTRACT

A method of charging coal into a chamber furnace-type coke oven. The coal is fed from a table feeder from a coal hopper so as to be dropped and charged into a carbonization chamber of the coke oven, through a charging cylinder. The coal fed from the table feeder is accelerated by rotation vanes at the initial stage in which the coal starts to drop. The vanes have a rotation center which is located upward on the exterior of a locus of the stream of free fall gravitated by the coal. The rotation speed of the vanes is progressively increased in the latter half of charging of the coal. The coal is thus allowed to accumulate in the carbonization chamber so that the bulk density of the coal in the vertical direction can become uniform. Also disclosed is an apparatus for charging coal into a chamber furnace-type coke oven. The apparatus includes a coal hopper for storing the coal therein. A table feeder feeds the coal from the hopper. Rotation vanes increases the speed of the coal fed from the feeder at the initial stage in which the coal drops from the feeder. The vanes have a rotation center which is located upward on the exterior of a locus of the stream of free fall gravitated by the coal. A charging cylinder guides the coal, which has been accelerated by the vanes and dropped into the carbonization chamber.

12 Claims, 10 Drawing Sheets

METHOD OF CHARGING COAL INTO CHAMBER FURNACE-TYPE COKE OVEN AND APPARATUS THEREFOR

BACKGROUND OF THE INVENTION

1. Field of the Invention

The present invention relates to a method of charging coal into a coke oven in a manner to decrease the disparity in the degree of bulk density of coal charged into a coke oven in the vertical direction so as to obtain a resultant coke of stable quality. The invention also relates to an apparatus employed in the same method.

2. Description of the Related Art

In general, a regenerator is placed at the bottom portion of a chamber furnace-type coke oven in which the coke is produced. A plurality of carbonization chambers and combustion chambers are alternately disposed at the top portion of the coke oven. Coal is charged into the carbonization chambers through a plurality of charging inlets which are placed in the longitudinal direction of the respective carbonization chambers. Further explanation of the prior art method will be discussed later with reference to the drawings.

A disparity in the degree of bulk density of coal from the lower portion to the upper portion of the coke oven gives rise to inconsistencies in the strength of the resultant coke, thus resulting in low product quality and low productivity.

In order to solve these problems, various methods and apparatuses have been developed.

For example, the following method is disclosed in Japanese Patent Laid-Open No. 57-36183 and is aimed to decrease the inconsistencies in the strength of the resultant coke caused by a lower bulk density in the upper layer of the coal which has been charged into the carbonization chamber. A vibrator is disposed at the forward end of a coal leveller so as to pressurize and vibrate the upper layer of the charged coal the surface of which has been levelled, thereby further increasing the bulk density.

Japanese Patent Laid-Open No. 60-15487 discloses another method employed whereby a rotatable compacting roller is disposed at the forward end of a coal leveller so that it can press the upper layer so as to make it even.

Also, Japanese Utility Model Laid-Open No. 57-150538 discloses an apparatus having a coal hopper which is constructed to be vertically movable by a hydraulic cylinder so as to increase the distance travelled by coal during free fall and to charge it into a carbonization chamber.

Further, Japanese Patent Publication No. 60-23140 discloses the following method to achieve a uniform distribution in bulk density of coal charged into a carbonization chamber of a coke oven in the vertical direction. A loading apparatus using a pair of belts is employed to accelerate the coal at a suitable velocity so as to charge it into the carbonization chamber, thereby also controlling the packing density and the distribution of bulk density of coal within the carbonization chamber.

A further method is disclosed in Japanese Patent Laid-Open No. 58-142972 to feed coal into a casing located on a charging inlet so as to accelerate the coal with an impeller and to charge it into the carbonization chamber. This method employs the following technique in order to achieve uniform bulk density of the coal charged in the carbonization chamber. It is expected that the speed of coal particles will be reduced because of air resistance while being accelerated, and thus, in the first half of the charging, charging velocity of the coal is progressively accelerated, and in the second half, the degree of acceleration is decreased.

Japanese Patent Laid-Open No. 3-796 discloses a method to control the bulk density of a raw material (coal) to be charged and to control the distribution of the bulk density. When the coal is charged into a carbonization chamber through a charging inlet of a chamber furnace-type coke oven, a leveller having rotation vanes provided for an extruder is inserted into the carbonization chamber from a levelling inlet so that the coal which falls straight down through the charging inlet strikes the rotation vanes driven by a motor so as to be accelerated and to be dropped into the carbonization chamber.

All of the foregoing conventional methods and apparatuses encounter problems.

The methods disclosed in Japanese Patent Laid-Open Nos. 57-36183 and 60-15487 are respectively employed whereby the vibrator and the compacting roller, together with a leveller, are allowed to advance the carbonization chamber of the coke oven. However, the apparatuses employed in these methods are complicated in construction and function. They are likely to suffer from the generation of dust, and breakdown is likely to occur in the carbonization chamber in an atmosphere having a high temperature. Thus, such apparatuses are not suitable for use over a long period.

The method disclosed in Japanese Utility Model Laid-Open No. 57-150538 also presents problems. The vertically-movable coal hopper is complicated in construction and function. It is likely to suffer from the generation of dust, and a breakdown is also likely to occur in the carbonization chamber in an atmosphere having a high temperature. Thus, such a apparatus is not suitable for use over a long period. Further, the load placed in the apparatus becomes too heavy so as to increase the normal load with respect to the surface of the coke oven, resulting in an unfavorable increase in load on the oven.

Moreover, the methods disclosed in Japanese Patent Publication No. 60-23140 and Japanese Patent Laid-Open No. 58-142972 each encounters problems in that a large apparatus and a complicated control are required, which further necessitates intensive and careful maintenance of equipment.

Also, even without carrying out the method disclosed in Japanese Patent Laid-Open No. 58-142972, it is still possible to obtain a result that when the coal is charged only by free fall, the longer distance travelled by the coal, the higher velocity at which the coal falls.

Further, the method disclosed in Japanese Patent Laid-Open No. 3-796 encounters the following problems. Since the rotation vanes are located immediately under the charging inlet, the coal which has fallen through the inlet from the hopper does not strike the same position of the vanes, and thus, the coal which has temporarily struck the vanes scatters around the vanes. This makes it difficult to control the direction and the velocity in which the coal is dropped into the carbonization chamber.

No matter what method and apparatus described above is employed, it requires not only a large apparatus and complicated control, but also necessitates intensive and careful maintenance of equipment.

SUMMARY OF THE INVENTION

Accordingly, an object of the present invention is to provide a novel coal charging method employed whereby coal is charged into a carbonization chamber of a chamber furnace-type coke oven so that a uniform bulk density of the coal charged therein can be achieved, and also to provide an apparatus employed in this method.

In order to achieve the above object, the present invention provides a method of charging coal into a chamber furnace-type coke oven, the coal having been fed from a table feeder and from a coal hopper so as to be dropped and charged into a carbonization chamber of the coke oven through a charging cylinder, the method involving the steps of:

(a.) accelerating the coal fed from the table feeder by means of rotation vanes at the initial stage in which the coal starts to drop, the vanes having a rotation center which is located upward on the exterior of a locus of free fall gravitated by the coal; and (b.) progressively increasing the rotation speed of the vanes in the latter half of the charging of the coal.

The present invention also provides an apparatus for charging coal into a chamber furnace-type coke oven, utilizing a coal hopper for storing the coal therein; a table feeder for feeding the coal from the hopper; rotation vanes for increasing the speed of the coal fed from the feeder at the initial stage in which the coal drops from the feeder, the vanes having a rotation center which is located upward on the exterior of a locus of free fall gravitated by the coal; and a charging cylinder for guiding the coal, which has been accelerated by the vanes and dropped, into the carbonization chamber.

Other means will become apparent from the following description and claims of the present invention.

DESCRIPTION OF THE PREFERRED EMBODIMENTS

To understand the present invention, a description of the prior art is presented, having reference to the drawings.

Figure 13:
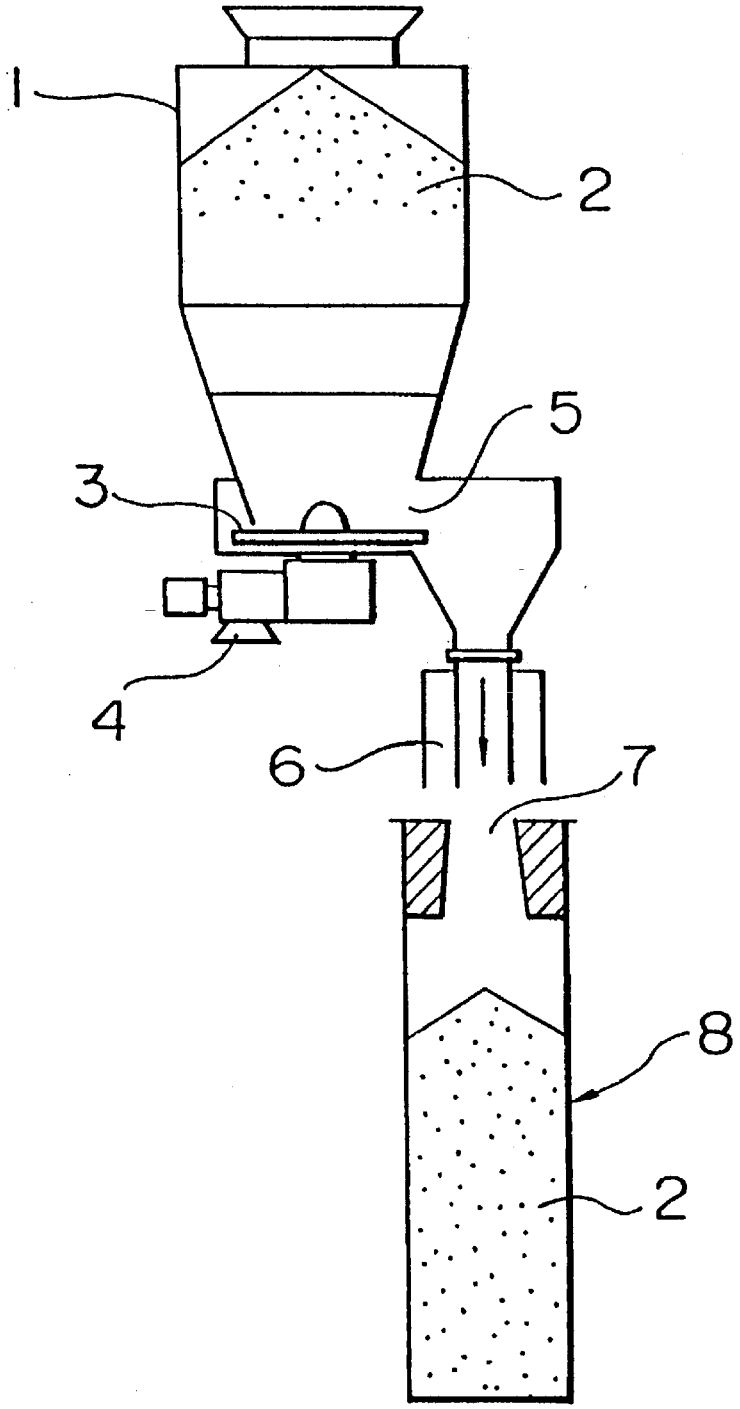
FIG. 13 PRIOR ART
FIG. 13 is a schematic view of a conventional coal charging apparatus.

FIG. 13 illustrates a conventional coal charging apparatus employed in the coke oven.

Referring to FIG. 13, a coal charging car (not shown) loaded with coal hoppers 1 runs in the widthwise direction of carbonization chambers 8. The number of the hoppers 1 are allowed to match that of the charging inlets 7 which are disposed in the longitudinal direction of the carbonization chambers 8. Coal 2 is fed from a table feeder 3 disposed below each of the hoppers 1 so as to be charged into the carbonization chamber 8 successively through a coal feeding outlet 5 and a coal charging cylinder 6.

The coal 2 charged into the carbonization chamber 8 forms an undulating surface having an apex immediately under each of the inlets 7 according to the angle of repose. In order to make this undulating surface even, a leveller (not shown) is disposed to repeatedly move back and forth several times from one end to the other end of the carbonization chamber 8 after the coal 2 has been charged, thereby making the undulating surface even.

Figure 14:
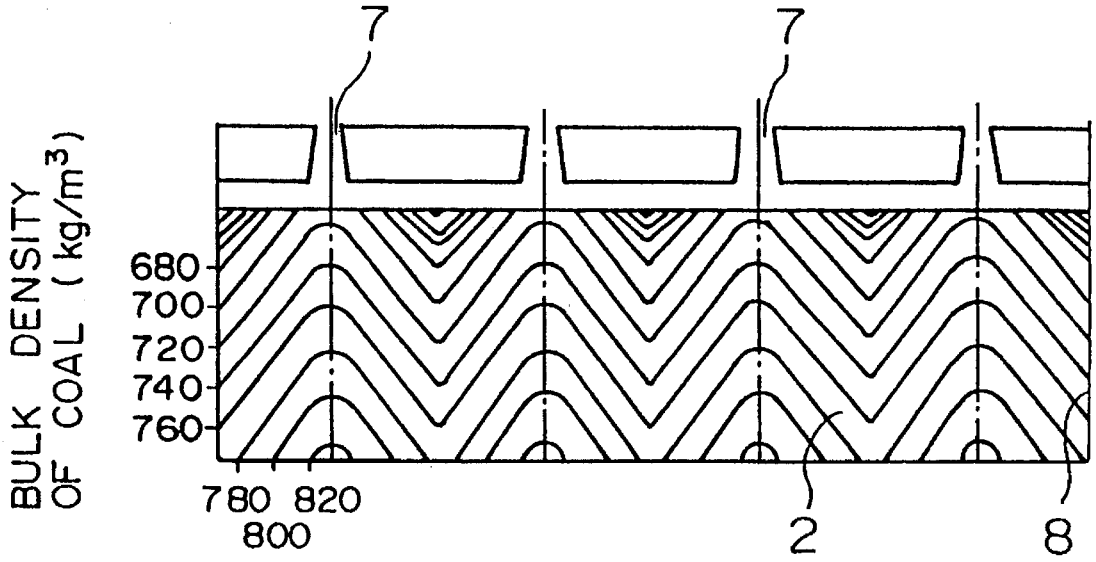
FIG. 14 PRIOR ART
FIG. 14 illustrates characteristics of the distribution of the bulk density of coal within a coke oven according to a conventional method.

As has been discussed above, the coal 2 is charged into the carbonization chamber 8 by free fall through the feeding outlet 5 and the inlet 7 which is located at the upper portion of the carbonization chamber 8. As is seen from FIG. 14 illustrative of the distribution of the bulk density of coal charged in the coke oven, a great bulk density can be achieved for the coal 2 placed in the lower portion of the carbonization chamber 8 since that coal 2 has travelled for a longer distance during free fall from the feeding outlet 5 to the lower portion of the carbonization chamber 8. On the other hand, the farther upward the coal 2 is located within the chamber 8, the smaller is the distance travelled by the coal 2 during free fall, thus progressively decreasing the bulk density.

Before explaining specific examples of the present invention, a description will first be given of an apparatus employed in the invention.

Figure 1:
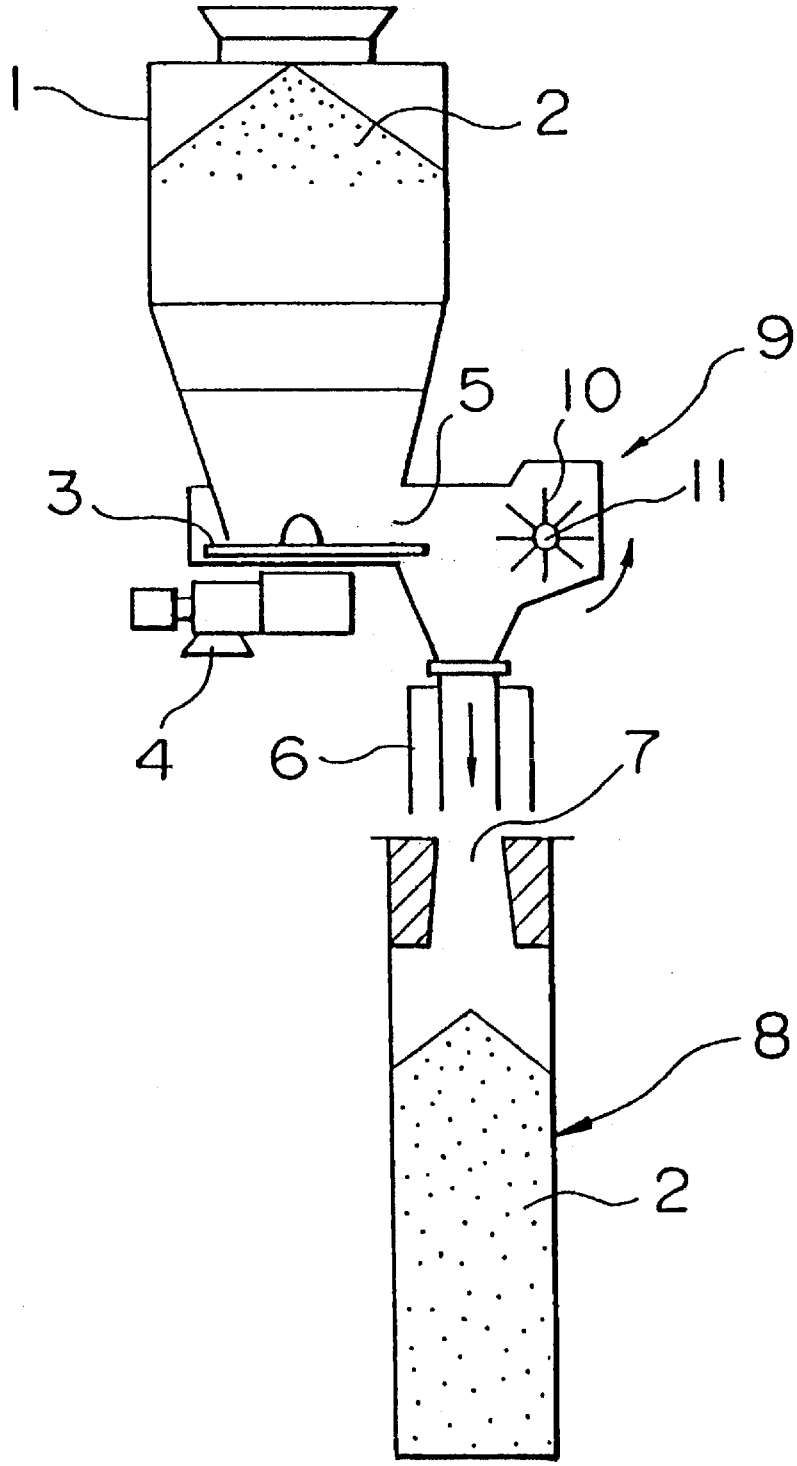
FIG. 1 is a schematic view of an apparatus for charging coal into a coke oven according to the present invention.

The schematic construction of the apparatus is shown in FIG. 1.

The apparatus comprises a coal hopper 1 filled with coal 2, and a table feeder 3 located at the bottom of the hopper 1 so as to feed a suitable amount of coal 2 through a coal feeding outlet 5 provided for the hopper 1. Rotation vanes 10 are securely held by a rotation drum 11. A rotation center 12 of this drum 11 is located upward on the exterior of the locus of the free fall of the gravitated coal 2 which is fed from the table feeder 3. It is mounted to be movable vertically and horizontally, i.e. close to and away from the table feeder 3. A charging cylinder 6 is used to guide the coal 2, which has been accelerated by the rotation vanes 10 so as to drop, to a carbonization chamber 8 of the coke oven.

A suitable amount of coal 2 is fed by the table feeder 3 from the coal hopper 1. It is then allowed to drop by virtue of free fall through the feeding outlet 5 and is further accelerated by the rotation vanes 10 so as to be charged into the carbonization chamber 8.

The inventors of this invention conducted various experiments with a view to achieving a method of charging the coal 2 from the hopper 1 to the carbonization chamber 8 in a good state. Through these experiments, they discovered the following facts.

Figure 2:
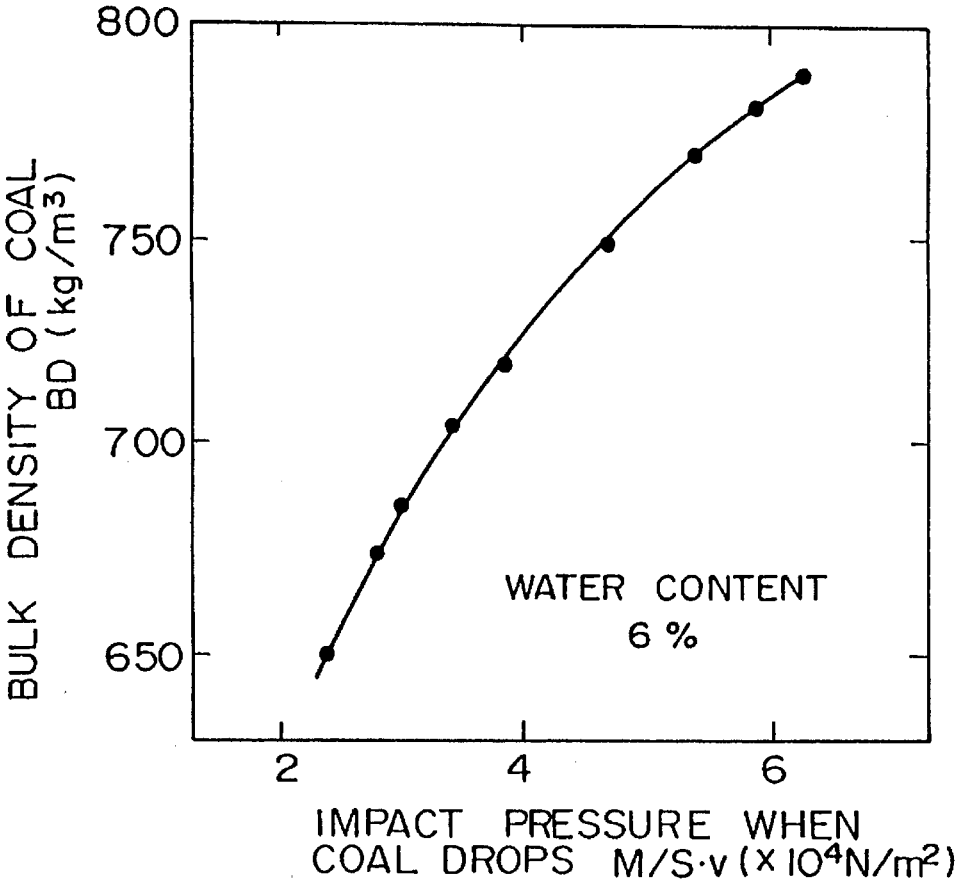
FIG. 2 illustrates characteristics of the relationship between the impact pressure caused when the coal is dropped and the bulk density of the coal.

FIG. 2 shows characteristics of the relationship between the impact pressure caused when the coal is dropped and the bulk density of the coal. As is seen from FIG. 2, the inventors found that there is a correlation between the bulk density BD ($kg/m^3$) of the coal within the carbonization chamber and the product of the charging velocity M/S ($kg/s/m^2$) per unit area (S indicates a cross-sectional area of the flow of coal or a collision cross-sectional area in which the flow of coal collides with a heap of coal which has been previously accumulated) and the velocity V (m/s) at which the flow of coal is newly accumulated on a heap of coal. Based on this fact, they further found that as a measure for controlling the bulk density of the coal in the vertical direction, it would be effective to adjust the velocity V at which the flow of coal is accumulated.

To put it more specifically, as in a prior art method, when the coal 2 loaded within the hopper 1 drops by virtue of free fall to be charged into the carbonization chamber 8, in the form as illustrated in FIG. 14, the coal 2 is accumulated to form a heap in the chamber 8 at an angle of repose corresponding to the water content of the coal in such a way that it has an apex immediately under each of the charging inlets 7.

The coal which is sequentially charged collides with the apexes of the heaps of coal, which are thus compacted by the impact pressure P ($N/m^2$) produced by the collision, thereby increasing the degree of bulk density of the coal.

The above-mentioned impact pressure P ($N/m^2$) can be obtained by dividing the drop impulsive force F(N) by the collision cross-sectional area S($m^2$), as shown in the following equation (1):

$$P=F/S\propto(M/S)\cdot V \quad (1)$$

wherein M indicates the coal charging speed (kg/sec) and V indicates the velocity (m/sec) at which the newly-charged coal is accumulated on a heap of coal. Equation (1) shows that the impact pressure P is proportional to [(M·V)/S].

As has been discussed above, FIG. 2 shows that there is a correlation between the product [(M/S)·V] and the bulk density BD ($kg/m^3$), where both terms are expressed in Equation (1). It is thus validated that the constant controlling of the product [(M/S)·V] throughout coal charging enables a uniform bulk density of the coal accumulated in the carbonization chamber in the vertical direction.

Figure 3:
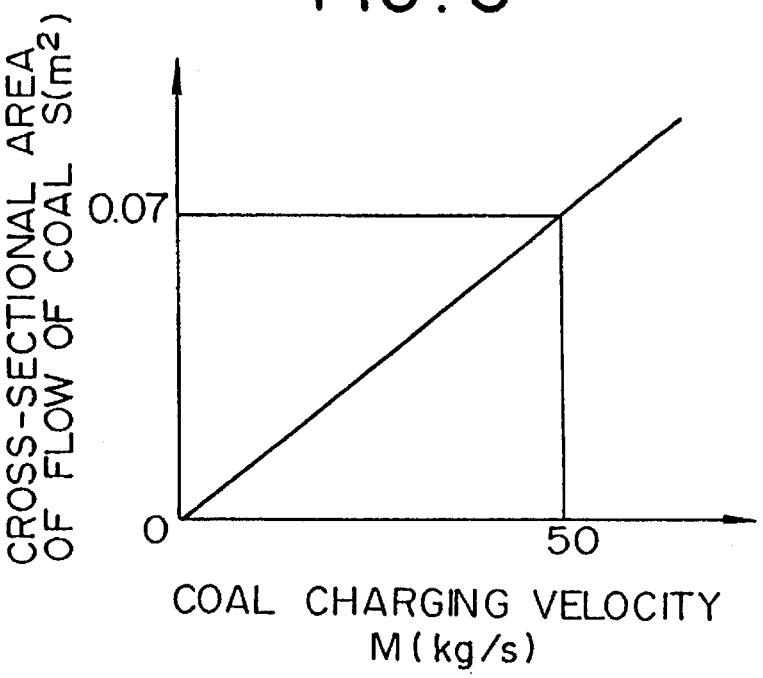
FIG. 3 illustrates characteristics of the relationship between the coal feeding velocity and the cross-sectional area of the flow stream of coal.

As shown in FIG. 3, since the velocity M/S becomes constant regardless of the coal charging velocity, the velocity V should be regulated so as to control the product [(M/S)·V].

At this stage, that is to say, as the amount of charged coal accumulated in the carbonization chamber increases, it is essential that, in the second half of charging coal, the rotation speed of the rotation vanes be progressively increased. The reason for performing this is that by accelerating drop velocity of the coal fed into the carbonization chamber, as the drop distance of the coal thereof becomes shorter, uniform bulk density of the charged coal in the vertical direction in the carbonization chamber is obtained. The increase ratio of the vane rotation speed can be determined on the basis of bulk density of the coal.

Figure 4:
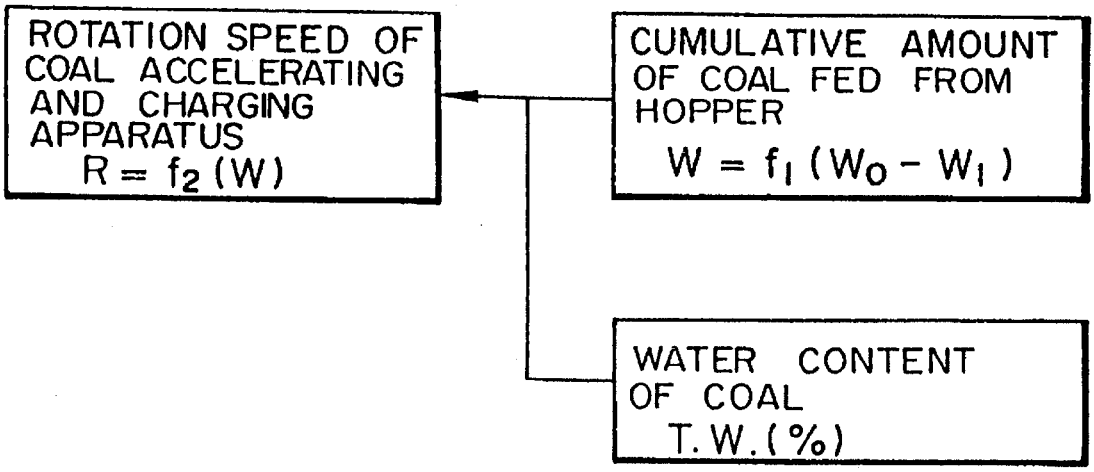
FIG. 4 is a flow diagram illustrative of the control of the rotation speed of rotation vanes employed in the present invention.

As illustrated in the flow diagram of FIG. 4, a method of charging coal to a coke oven according to the present invention is employed so that the velocity V can be kept constant as follows. The cumulative amount $W=f_1(W_0-W_1)$ of coal fed from the coal hopper is measured with a load cell which is provided for the hopper. Upon receipt of the measurement signal from the load cell, the accelerating rotation R of the coal accelerating and charging apparatus is riggered to start, and thus, the coal to be charged into the carbonization chamber is provided with the initial velocity. As a consequence, the velocity V can be controlled to be constant.

In the equation of the cumulative amount $W=f_1(W_0-W_1)$, $W_0$ indicates the weight of coal supplied to the hopper from a coal tower; and $W_1$ indicates the amount of remaining coal within the hopper while the coal is charged.

Figure 5:
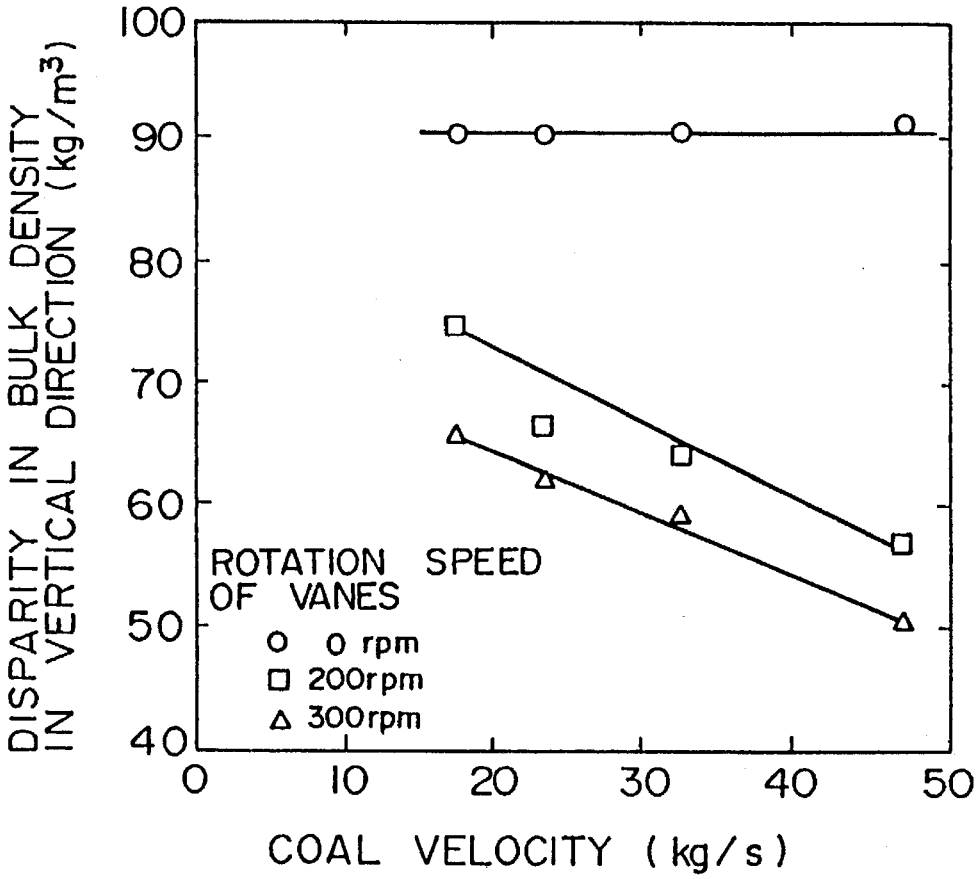
FIG. 5 illustrates characteristics of a disparity in the degree of bulk density in the vertical direction with respect to the coal feeding velocity by a table feeder when the coal is to be charged.

On the other hand, it is also effective for achieving uniform bulk density when coal feeding velocity of the coal fed by a table feeder, in the second half, is progressively increased. FIG. 5 illustrates effect of the vane rotation speed and feeding speed of the coal from the table feeder, which are progressively increased, with respect to the bulk density of the coal in the vertical direction in the coke oven.

Figure 6:
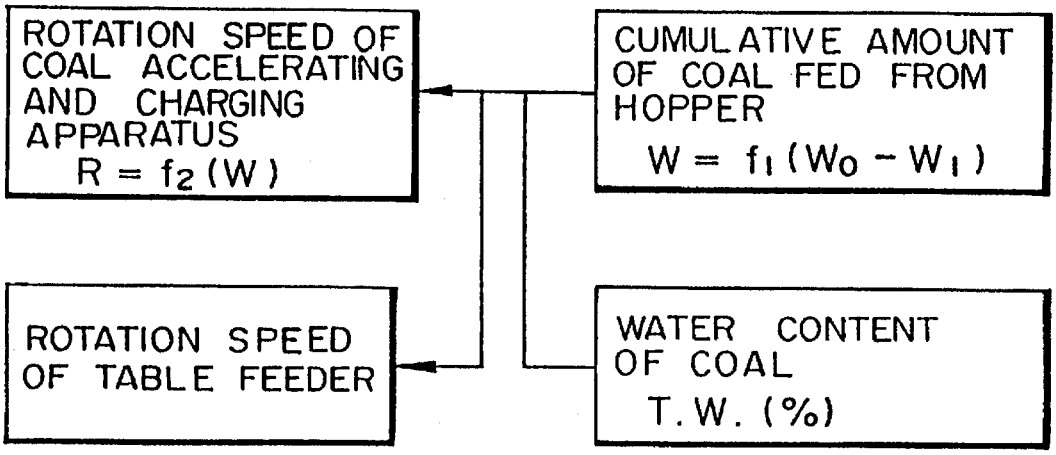
FIG. 6 is a flow diagram illustrative of the controls of the rotation speed of vanes and that of a table feeder employed in the present invention.

To further develop the above-described fact, as illustrated in FIG. 6, there can be provided a method of achieving uniformity of bulk density obtained by a combination of the control of coal feeding velocity and the regulation of the vane rotation speed, thereby enhancing the uniformity of the bulk density of coal in the coke oven in the vertical direction.

The coal feeding velocity can be controlled by making adjustments to the rotation speed of the table feeder.

Figure 7:
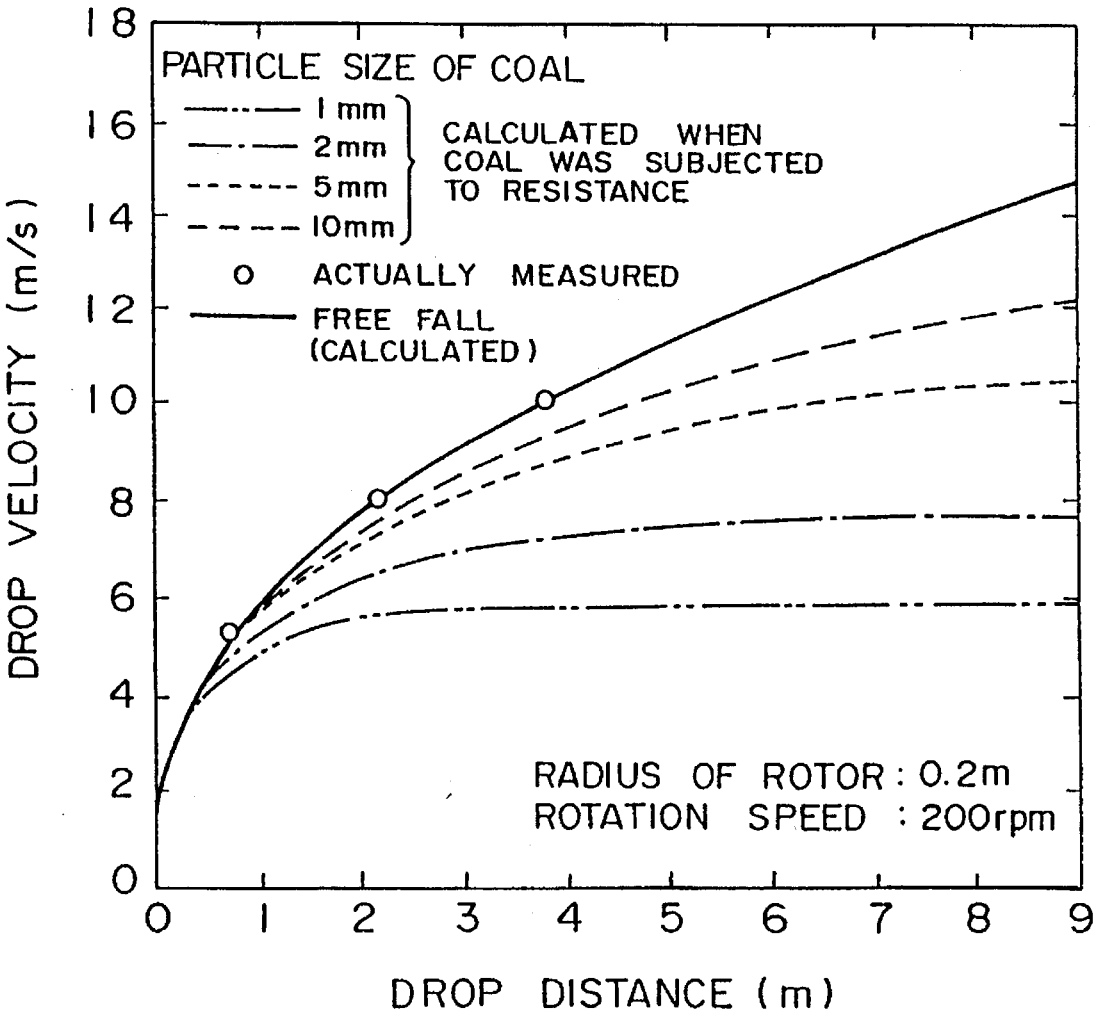
FIG. 7 illustrates characteristics of the relationship between the drop distance of coal particles and the drop velocity thereof.

In general, when coal particles drop while being subjected to gas resistance, such resistance reduces the speed of the particles to a predetermined velocity as the drop distance (or drop duration) increases. FIG. 7 illustrates the characteristics of the relationship between the drop distance of coal particles of various sizes and the drop velocity. As is seen from FIG. 7, various experiments conducted according to the method of the present invention show that some types of coal particles were not subjected to gas resistance produced in the coke oven when charged thereinto, and thus, the drop velocity of the coal was not reduced.

This may result from the following assumption. A large volume of coal in the form of the flow of powder is accelerated to drop, and sometimes involves air in the vicinity of the powder flow so powder and air flow together. This hardly produces air resistance.

An apparatus of the present invention will now be described in more detail.

Figure 8:
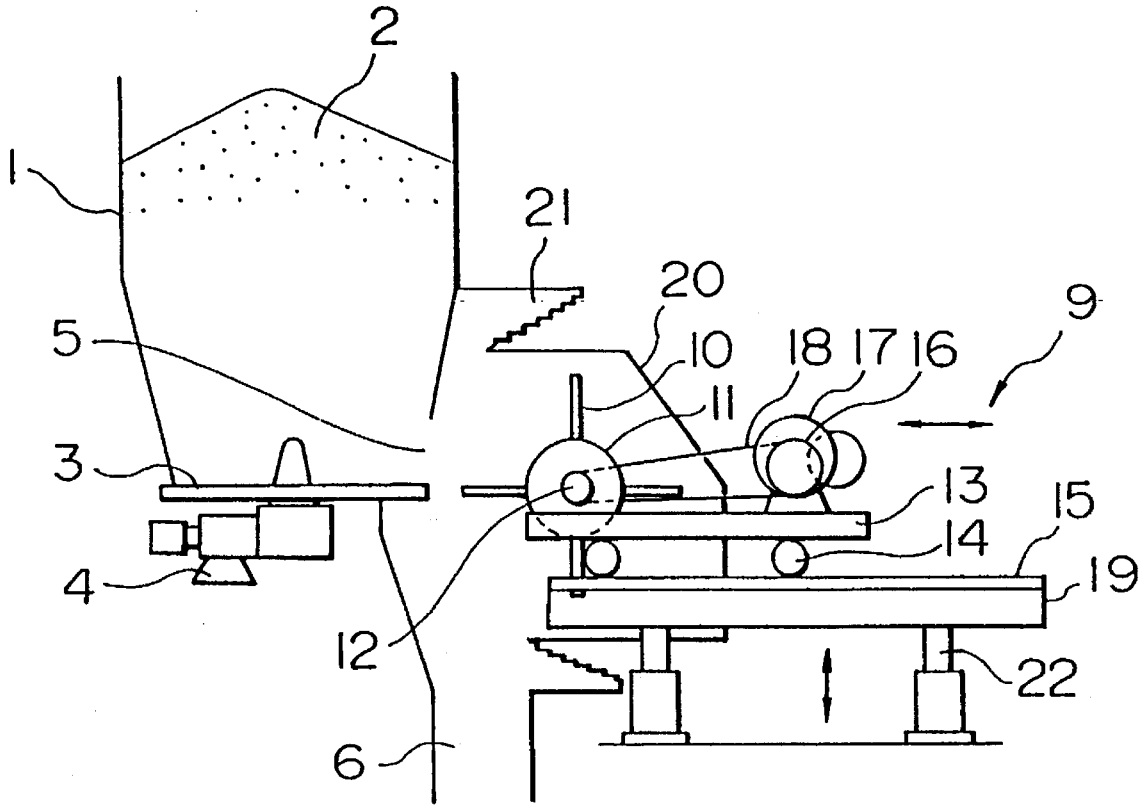
FIG. 8 is a side sectional view of a coal accelerating and charging apparatus employed in the present invention.
Figure 9:
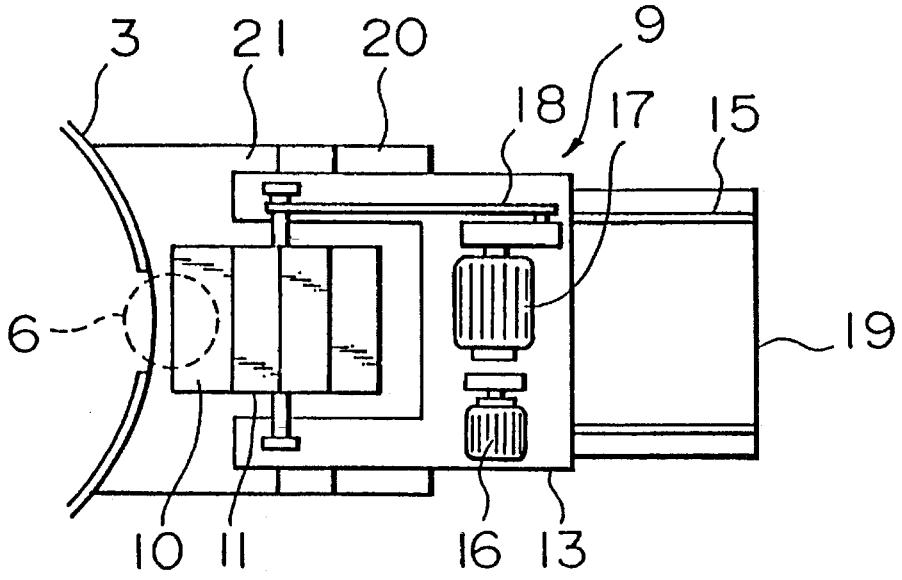
FIG. 9 is a top view of the apparatus shown in FIG. 8.

FIG. 8 is a side sectional view of the apparatus according to the present invention. FIG. 9 is a top view of the apparatus shown in FIG. 8. As previously discussed above, the apparatus comprises the coal hopper 1 filled with the coal 2, and the table feeder 3 which is rotatively driven by a motor (not shown) via a pulley 4 so as to continuously feed the coal 2 on the table feeder 3 through the coal feeding outlet 5.

The coal 2 fed from the feeder 3 is accelerated by a coal accelerating and charging apparatus 9 so as to be accumulated in the carbonization chamber 8 successively through the charging cylinder 6 and the charging inlet 7.

The coal accelerating and charging apparatus 9 comprises the rotation vanes 10 securely held by the rotation drum 11, and a running carriage 13 loaded with the vanes 10 so as to be horizontally movable. The rotation drum 11 is rotatably fixed on the carriage 13 via a chain belt 18 by the rotation motor 17 mounted on the carriage 13. The rotation center 12 of the drum 11 is located upward on the exterior of the locus of the free fall gravitated by the flow of the coal 2. It is also located to be movable vertically and also horizontally, i.e. close to and away from the table feeder 3.

The carriage 13 is horizontally moved by a carriage motor 16 through wheels 14 running on a rail 15 which is mounted on a base 19. The adjustments of the up-and-down movements of the rotation vanes 10 can be performed by moving vertically moving cylinders 22 together with the base 19.

A dust preventing cover 20 attached to the carriage 13 is fixed to one end of a flexible accordion seal 21 which is connected at the other end to the coal hopper 1 so that the cover 20 can move horizontally together with the carriage 13.

An explanation will now be given of the relationship of the arrangement of the rotation vanes 10 to the table feeder 3. If the rotation vanes 10 are located in such a way that the flow of coal 2 fed from the feeder 3 cannot be entirely accelerated by the rotation vanes 10, the bulk density of the coal 2 accumulated within the carbonization chamber 8 does not become uniform along the height of the chamber 8.

If the rotation center 12 of the drum 11 is located within or downward on the exterior of the locus of the free fall gravitated flow of coal, the coal fed from the table feeder 3 advances the central portion of the vanes 10 so as to be drawn thereinto. This causes the generation of dust, and also generate the turbulence in the flow of coal 2 which is being accelerated, resulting in the nonuniformity of the bulk density of the coal accumulated in the carbonization chamber 8.

Figure 10A:
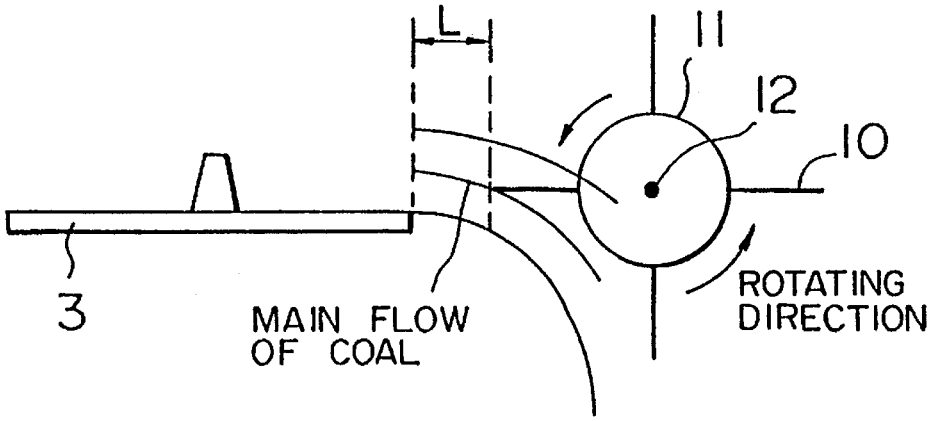
FIGS. 10A, 10B and 10C each illustrates the position of the arrangement of a drum provided with rotation vanes.
Figure 10B:
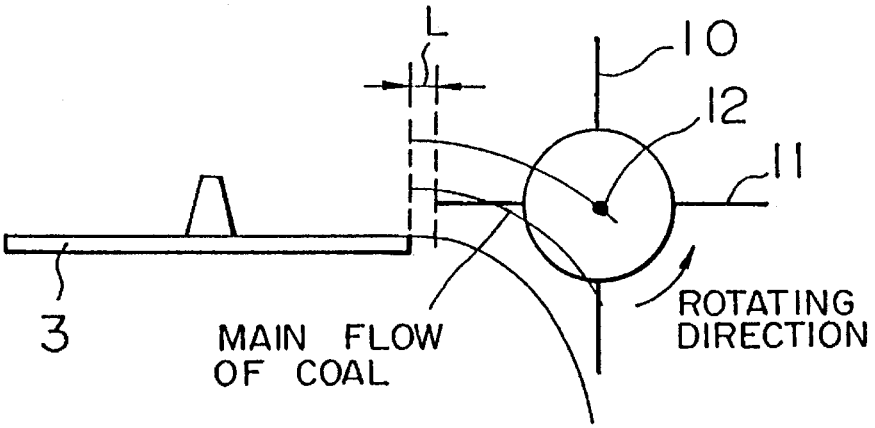
Figure 10C:
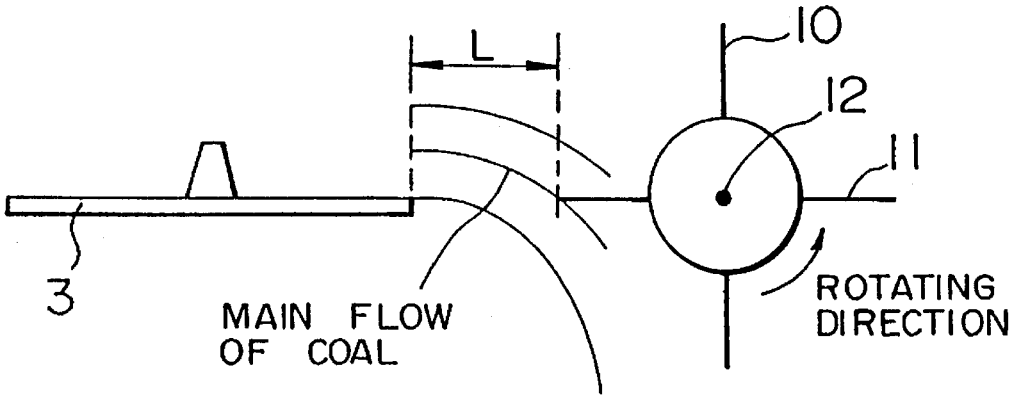

In order to avoid this inconvenience incurred by the misarrangement of the vanes to the table feeder and to make the distribution of the bulk density of the coal 2 uniform along the height of the carbonization chamber 8, the following measures can be effectively employed. Concerning the relationship of the vanes 10 to the table feeder 3, as shown in FIGS. 10A, 10B and 10C, adjustments should be made so that the rotation center 12 of the drum 11 can be located upward on the exterior of the locus of the free fall gravitated flow of coal 2 and that the distance L from the coal feeding outlet 5 provided for the table feeder 3 to the forward end of the vane 10 can be a suitable value. Additionally, it is effective to increase the rotation velocity of the drum 11 as the amount of coal 2 charged into the carbonization chamber 8 accumulates.

When the flow of coal 2 is accelerated by the rotation vanes 10 so as to drop through the coal feeding outlet 5 of the table feeder 3, it is flared to some extent while being charged into the carbonization chamber 8. If the coal 2 is flared to a great extent, it collides with the side walls of the charging cylinder 6 so as to slow the drop velocity of the coal 2, thereby giving rise to a decrease in the effect of achieving the uniformity of the bulk density of the coal 2. For minimizing such a disadvantage and promoting the velocity (vector) of the coal 2 in the downward direction, it is extremely effective to form the vanes 10 in a V-shape, as shown in FIG. 11B.

Further, the number of vanes 10 is determined to be from four to eight, to remarkably improve the acceleration efficiency of the coal 2.

Specific examples of the present invention will now be described.

First Example

A coal accelerating and charging apparatus was employed under the following conditions: the height of the oven was 4 m; the distance from the table feeder disposed below the coal hopper to a carbonization chamber was 6.5 m; and the width of the carbonization chamber was 40 cm. Coal having a water content of 6% was fed from the hopper at a velocity of from 20 to 80 kg/sec and was accelerated under the following conditions so as to drop and to be charged into the carbonization chamber. Coal specimens were sampled from the sampling pores in the carbonization chamber so as to examine the distribution of the bulk density of the coal charged in the carbonization chamber.

Figure 11A:
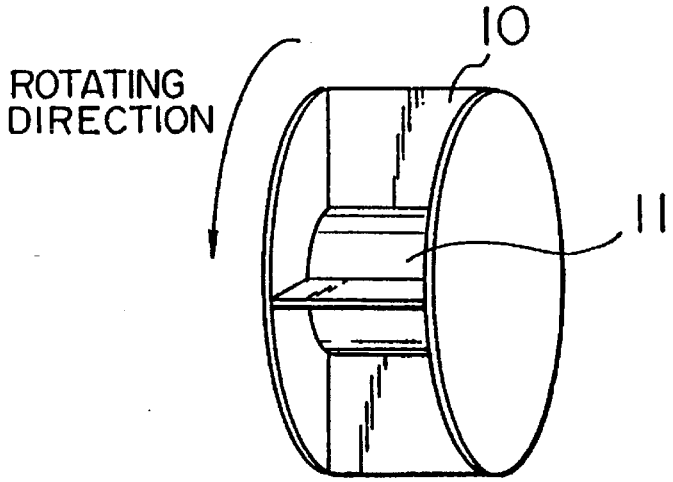
FIGS. 11A, 11B and 11C each illustrates the configuration of the rotation vanes.
Figure 11B:
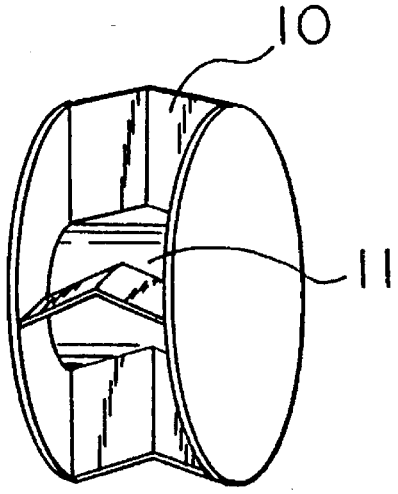

Coal charging conditions:

This example employed an apparatus with a rotation drum having a radius of 0.2 m provided with four rotation vanes (the vanes employed in this example were radially extended and formed to be flattened, as shown in FIG. 11A, the radius of the drum being measured from the rotation center of the drum to the end of the vane). The rotation speed of the drum was adjusted so that it would be changed from 0 to 500 rpm while the coal was being charged. A level at which the vane was horizontally placed was allowed to match that of the outlet of the table feeder, and the distance L from the outlet to the forward end of the vane was adjusted to fall within a range from 5 to 30 cm.

Table 1 shows the results obtained by examining the bulk density distribution of the coal within the carbonization chamber in comparison with those when the coal was charged according to a conventional method (the coal was merely charged by free fall).

TABLE 1

| Coal | Disparity in Degree of Bulk Density of Coal Located in Upper and Lower Portions Of Oven | | | | | |
|---|---|---|---|---|---|---|
| Feeding Velocity | Example of Conventional | Examples of the Invention | | | | |
| (kg/s) | Method | L = 5 cm | L = 10 cm | L = 15 cm | L = 30 cm | L = 50 cm |
| 40 | 96 | 20 | 24 | 40 | 70 | 94 |
| 60 | 95 | 44 | 15 | 16 | 68 | 88 |
| 80 | 90 | 40 | 33 | 18 | 29 | 80 |

Note)
Coal Sampling Position:
Upper Portion: 3.0 m from the Bottom of the Oven
Lower Portion: 0.3 m from the Bottom of the Oven As is clearly seen from Table 1, in contrast to the conventional method employed whereby there is a great disparity, as much as from 90 to 96 kg/m$^3$, in the bulk density of coal in the carbonization chamber in the vertical direction, an extremely low disparity in a degree of bulk density can be achieved, and the density is thus substantially uniform according to these examples of the present invention.

In particular, at a feeding velocity of 40 kg/sec, since the coal hardly flows in the horizontal direction, the maximum acceleration efficiency can be achieved when the distance L is 5 cm. Thereafter, as the feeding velocity increases, the distance L at which the maximum acceleration efficiency can be achieved becomes greater. This may be because of the assumption that there is an increase in the velocity at which the coal is fed from the table feeder. From the foregoing description, it is validated that the following factor is most important for increasing the acceleration efficiency when coal is accelerated to be charged in the carbonization chamber. That is, the rotation vanes should be arranged in relation to the table feeder so that the entire flow of coal can be completely accelerated by the rotation vanes of the accelerating and charging apparatus and that the flow of coal can be avoided from colliding with the vane located forward of the accelerating vane.

Second Example

Figure 11C:
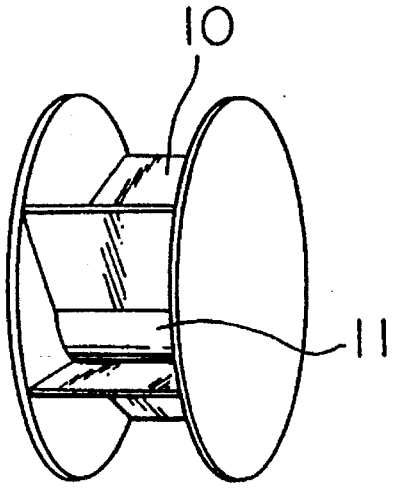

A coal accelerating and charging apparatus with a built-in rotation drum which was provided with four rotation vanes was employed. The drum had a diameter of 100 mm and a width of 57 mm (both dimensions measured including the vanes). Various types of the vanes were employed in this example: flattened vanes (See FIG. 11A); V-shaped vanes at a bending angle of 90° (See FIG. 11B); and flattened and rearward-tilting vanes at a tilting angle of 17° in relation to the straight line passing through the center of the rotation drum, which vanes tilt in the direction opposite to the rotation direction of the drum (See FIG. 11C). By use of these types of vanes, the coal was charged into the carbonization chamber (at a charging velocity of 90 g/sec and at a drum rotation speed of 500 rpm). Then, the dispersions of the coal were examined.

Figure 12:
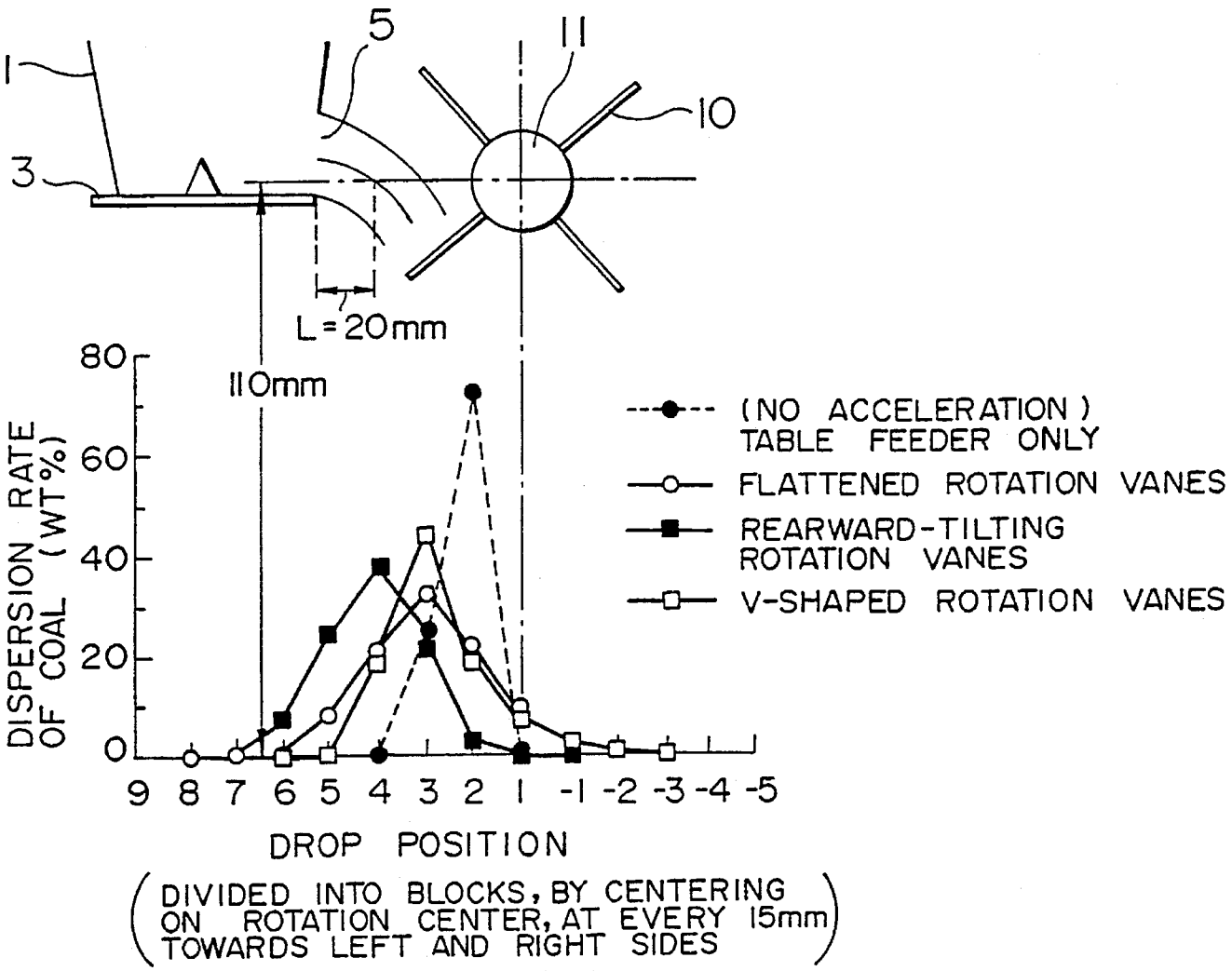
FIG. 12 illustrates the relationship between the dispersion ratio of the coal and the position in which the coal is dropped in the carbonization chamber.

The dispersions are shown in FIG. 12 in comparison with that obtained by a conventional method employed whereby coal was charged simply by using a table feeder without applying additional acceleration.

As is clearly seen from FIG. 12, among the apparatuses employed whereby the coal was accelerated by the above-described vanes to be charged, smaller dispersions in the flow of coal under acceleration can be achieved by the apparatuses respectively provided with the V-shaped vanes (See FIG. 11B) and the rearward-tilting vanes (See FIG. 11C) as compared to that provided with the flattened vanes (See FIG. 11A). It is thus confirmed that, in particular, an apparatus provided with V-shaped vanes produces a remarkable effect of decreasing the dispersion.

Third Example

A coal accelerating and charging apparatus was employed under the following conditions: the height of the oven was 4 m; the distance from the table feeder disposed below a coal hopper to the bottom of a carbonization chamber was 6.5 m; the width of the carbonization chamber was 40 cm. Various types of coal having a water content of from 6 to 10% were fed from the hopper at a velocity of 60 kg/sec and were accelerated under the following conditions so as to drop and be charged into the carbonization chamber. Coal specimens were sampled from the sampling pores in the carbonization chamber so as to examine the distribution of the bulk density of the coal charged in the carbonization chamber.

Coal charging conditions:

This example employed an apparatus with a rotation drum having a radius of 0.2 m provided with four rotation vanes. The two types of vanes employed in this example, i.e. flattened vanes and V-shaped vanes, and the rotation center was located upward on the exterior of the locus of the free fall stream gravitated by the flow of coal. The rotation speed of the drum was adjusted so that it would be changed from 0 to 500 rpm while the flow of coal was being charged. The distance L from the forward end of the vane to the outlet of the table feeder was adjusted to be 15 cm.

Table 2 shows the results obtained by examining the bulk density distribution of the coal within the carbonization chamber in comparison with those when the coal was charged according to a conventional method (the coal was charged merely using an electromagnetic feeder).

TABLE 2

| | Disparity in Degree of Bulk Density of Coal Located in Upper and Lower Portions of Ovens | | |
|---|---|---|---|
| Water Content of Coal | Example of Conventional Method | Examples of the Invention | |
| (%) | — | Flattened Vanes | V-Shaped Vanes |
| 6 | 95 | 15 | 11 |
| 8 | 92 | 16 | 10 |
| 10 | 96 | 12 | 9 |

Note)
Coal Sampling Position:
Upper Portion: 3.0 m from the Bottom of the Oven
Lower Portion: 0.3 m from the Bottom of the Oven As is seen from Table 2, according to the conventional method, there is a great disparity, as much as from 92 to 96 $kg/m^3$, in the bulk density of coal in the oven in the vertical direction, while the apparatus provided with flattened vanes was employed so that a disparity was decreased to 15 $kg/m^3$, 16 $kg/m^3$ and 12 $kg/m^3$ when the coal respectively contains 6%, 8% and 10% water. Further, when the apparatus provided with V-shaped vanes was employed, there were remarkable improvements in the disparity in a degree of bulk density, such as 11 $kg/m^3$, 10 $kg/m^3$ and 9 $kg/m^3$, when the coal respectively contains 6% 8% and 10% water.

Fourth Example

A coal accelerating and charging apparatus was employed in this example under the following conditions: the height of the oven was 4 m; the distance from the table feeder disposed below a coal hopper to the bottom of the carbonization chamber was 6.5 m; the width of the carbonization chamber was 40 cm. Various types of coal having a water content of from 6 to 10% were fed from the hopper at a velocity of 60 kg/sec and were accelerated under the following conditions so as to drop and be charged into the carbonization chamber. Coal specimens were sampled from the sampling pores in the carbonization chamber so as to examine the distribution of the bulk density of the coal charged in the carbonization chamber.

Coal charging conditions:

This example employed an apparatus with a rotation drum having a radius of 0.2 m provided with rotation vanes. The number of vanes was variously changed in a range from 2 to 20 (the flattened vanes were employed in this example). The rotation speed of the drum was adjusted so that it would be changed from 0 to 500 rpm while the coal was being charged. The distance L from the forward end of the vane to the outlet of the table feeder was adjusted to be 15 cm.

Table 3 shows the results obtained by examining the bulk density distribution of the coal within the carbonization chamber in comparison with those when the coal was charged according to a conventional method.

TABLE 3

| Water Content of Coal (%) | Disparity in Degree of Bulk Density of Coal Located in Upper and Lower Portions of Ovens | | | | | |
|---|---|---|---|---|---|---|
| | Example of Conventional Method — | Comparative Example 2 vanes | Examples of the Invention 4 vanes | 8 vanes | Comparative Example 12 vanes | 20 vanes |
| 6 | 95 | 59 | 15 | 12 | 55 | 70 |
| 8 | 92 | 62 | 16 | 15 | 52 | 57 |
| 10 | 96 | 57 | 12 | 15 | 58 | 64 |

Note)
Coal Sampling Position:
Upper Portion: 3.0 m from the Bottom of the Oven
Lower Portion: 0.3 m from the Bottom of the Oven As is seen from Table 3, according to the conventional method, there is a great disparity, as much as from 92 to 95 kg/m$^3$, in the bulk density of coal in the oven in the vertical direction, while according to a method employed whereby the coal was accelerated to be charged into the oven, such a disparity decreases to 70 kg/m$^3$ or lower. In particular, when the apparatus provided with from four to eight vanes was employed, a disparity in a degree of bulk density of coal was reduced to no more than from 10 to 16 kg/m$^3$. It is thus validated that extremely remarkable improvements in the uniformity of the bulk density can be achieved in this range of the number of vanes.

This may be because of the following assumption. If the number of vanes is less than four, there is a decrease in the frequency at which the coal collides with the vanes, which thus decreases the amount of coal to be accelerated. On the other hand, if the number of vanes is more than eight, there is an increase in the amount of coal to be scattered by the vanes, which disadvantageously decreases the amount of coal to be accelerated while dropping.

As is clearly seen from the foregoing description, the present invention offers the following advantages.

The uniformity of bulk density of the coal charged into the carbonization chamber of the coke oven in the vertical direction can be achieved (in particular, the bulk density of coal located in the upper portion of the carbonization chamber can be enhanced). Hence, there can be improvements in quality and productivity of a resultant coke.

What is claimed is:

1. A method of charging coal into a chamber furnace-type coke oven, the coal having been fed from a table feeder from a coal hopper so as to be dropped and charged into a carbonization chamber of said coke oven through a charging cylinder, said method comprising the steps of:

a. accelerating the coal fed from said table feeder by means of rotation vanes at an initial stage in which the coal starts to drop, said vanes having a rotation center which is located upward on a exterior of a locus of free fall gravitated by the coal;

b. progressively increasing a rotation speed of said vanes in a latter half of the charging of the coal; and c. allowing the coal to accumulate in said carbonization chamber so that the bulk density of the coal in the vertical direction becomes uniform.

2. A method according to claim 1, wherein the rotation center of said vanes is moved horizontally or vertically according to the quality and volume of the coal.

3. A method according to claim 2, wherein a distance L from an outlet of said table feeder to a forward end of said vane is adjusted to fall within a range from 5 to 20 cm.

4. A method according to claim 1, wherein a charging velocity of the coal fed from said table feeder is progressively increased in the latter half.

5. A method according to claim 2, wherein a charging velocity of the coal fed from said table feeder is progressively increased in the latter half.

6. An apparatus for charging coal into a chamber furnace-type coke oven, comprising:

a coal hopper for storing the coal therein;

a table feeder for feeding the coal from said hopper;

rotation vanes for increasing the speed of the coal fed from said feeder at the initial stage in which the coal drops from said feeder, said vanes having a rotation center which is located upward on an exterior of a locus of free fall gravitated by the coal; and a charging cylinder for guiding the coal, which has been accelerated by said vanes and dropped, into said carbonization chamber.

7. An apparatus according to claim 6, comprising means for horizontally and vertically moving the rotation center of said vanes.

8. An apparatus according to claim 6, wherein said vanes attached to a drum are each bent in a V-shape in a vicinity of a central portion of said drum.

9. An apparatus according to claim 7, wherein said vanes attached to a drum are each bent in a V-shape in a vicinity of a central portion of said drum.

10. An apparatus according to claim 6, wherein the number of said vanes is from four to eight.

11. An apparatus according to claim 7, wherein the number of vanes is from four to eight.

12. An apparatus according to claim 8, wherein the number of vanes is from four to eight.

* * * * *